United States Patent [19]

Day

[11] 4,020,600

[45] May 3, 1977

[54] POLISHING FIXTURE

[75] Inventor: Lawrence Day, Mount Prospect, Ill.

[73] Assignee: Spitfire Tool & Machine Co., Inc., Chicago, Ill.

[22] Filed: Aug. 13, 1976

[21] Appl. No.: 714,183

[52] U.S. Cl. ..... 51/237 R; 51/131

[51] Int. Cl.[2] ..... B24B 37/04

[58] Field of Search ..... 51/129, 131, 133, 236, 51/237 R, 237 M

[56] References Cited

UNITED STATES PATENTS

| | | | |
|---|---|---|---|
| 2,581,106 | 1/1952 | Indge | 51/131 |
| 3,233,370 | 2/1966 | Best | 51/131 |
| 3,455,067 | 7/1969 | Thomas | 51/131 X |
| 3,518,798 | 7/1970 | Boettcher | 51/131 |
| 3,631,634 | 1/1972 | Weber | 51/131 |
| 3,683,562 | 8/1972 | Day | 51/131 |

*Primary Examiner*—Al Lawrence Smith
*Assistant Examiner*—Nicholas P. Godici
*Attorney, Agent, or Firm*—Edward C. Threedy

[57] ABSTRACT

A high pressure polishing fixture assembly having a vertically movable pressure plate providing depending means for engagement with a plurality of workpiece-carrying heads positionable under pressure upon a rotatable polishing plate.

9 Claims, 4 Drawing Figures

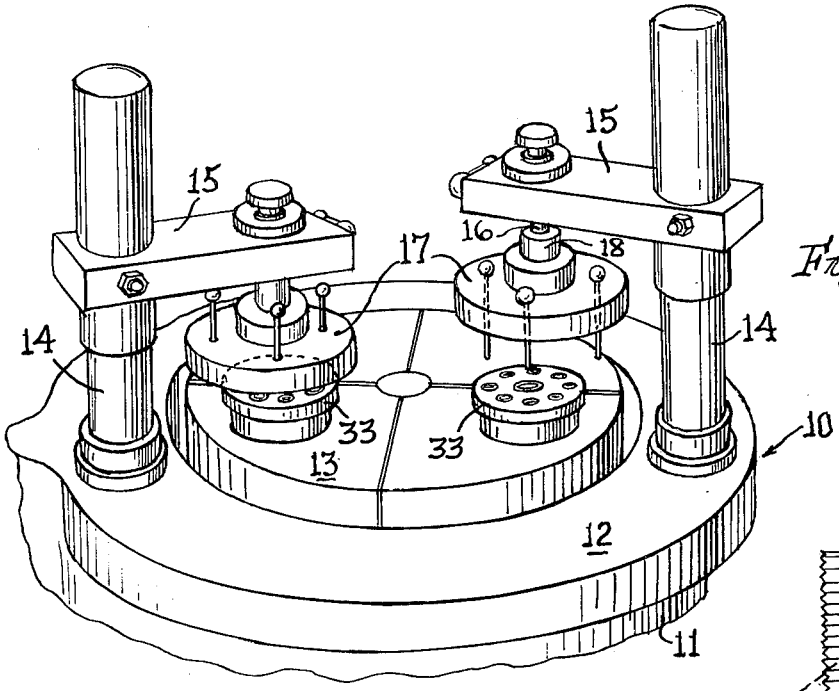
Fig. 1.
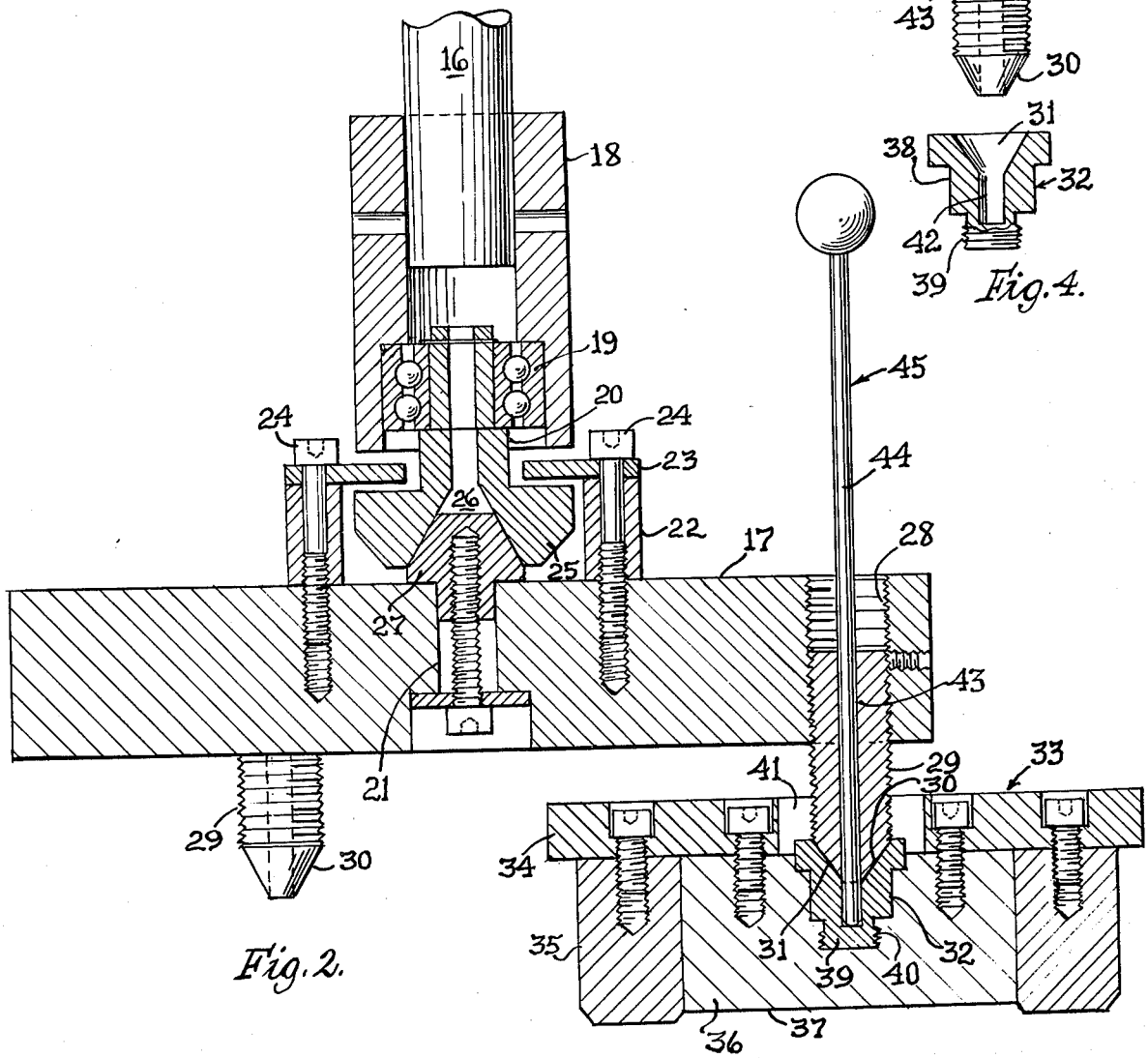
Fig. 2.
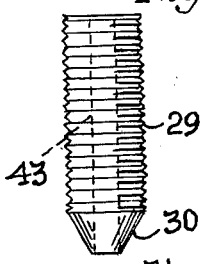
Fig. 3.
Fig. 4.

POLISHING FIXTURE

BACKGROUND OF THE INVENTION

The present invention relates generally to a fixture adapted to be associated with a polishing machine having a rotatable polishing plate. The fixture is vertically movable relative to the polishing plate and provides a circular pressure plate having depending means engageable with individual workpiece-carrying heads whereby pressure may be applied through the pressure plates onto the heads and the workpieces carried thereby as the latter are being polished.

The prior apparatuses normally provided a pressure plate having full facial engagement with a workpiece carrier, and, when pressure was applied thereto, distortion resulted due to the height differences in the workpieces and the engaging surfaces of the pressure plate and the workpiece carrier. It is an object of the present invention to overcome this type of error during the polishing operation.

SUMMARY OF THE INVENTION

The principal object of this invention is to provide a fixture for polishing wafers comprised of silicon and the like. To apply uniform pressure during the polishing operation, the fixture provides a pressure plate that has a swivel coupling to its supporting spindle whereby the pressure plate has a floating action relative to a plurality of work heads that are in engagement with depending pressure pins provided by the pressure plate. It is desirable that each pin have a universal coupling to its respective work head so as to minimize deflection between the pressure plate and the heads when the latter are under pressure.

DESCRIPTION OF THE DRAWINGS

FIG. 1 is a fragmentary perspective view of a polishing machine incorporating the principles of the present invention;

FIG. 2 is a fragmentary detail sectional view of the present invention;

FIG. 3 is an elevational view of one of the pressure pins of the invention;

FIG. 4 is a sectional view of the universal receiving socket employed in the invention.

GENERAL DESCRIPTION

Referring to FIG. 1, there is indicated generally a polishing machine 10 which includes a base portion 11 supporting a horizontally disposed apron 12. This apron 12 surrounds a rotatable polishing plate 13. Carried by and extending vertically from the apron 12 are shown a pair of vertical columns 14, each of which in turn supports a lateral arm 15. The construction and operation of the vertical columns 14 and the respective lateral arms 15 is that of the type shown and described in U.S. Pat. No. 3,032,937.

As shown in FIG. 1, each of the lateral arms 15 provides a depending spindle 16 which in turn supports a circular pressure plate 17. The connection between the spindle 16 and the pressure plate 17 is shown in detail in the sectional view of FIG. 2. As such, it is shown that to the free end of the spindle 16 there is mounted a coupler 18. This coupler 18 in turn supports internally a ball bearing assembly 19, which in turn supports a depending adaptor 20. The pressure plate 17 is provided with a center bore 21 which is surrounded by a retainer ring 22 carried by the upper surface of the pressure plate 17. Mounted onto the retainer ring 22 is a collar 23. The collar 23 is connected to the retainer ring 22 while the latter is attached to the pressure plate 17 by means of bolts 24.

As shown in FIG. 2, the collar 23 extends inwardly of the retainer ring 22 and projects between the bottom edge of the coupler 18 and the ball bearing assembly 19 and the enlarged adaptor end 25. The adaptor end 25 is provided with a centrally located inverted cone-shaped opening 26 which is adapted to receive the truncated positioning plug 27 carried by the pressure plate 17. From the foregoing description, it is apparent that there is provided a swivel type connection between the spindle 16 and the pressure plate 17.

The circular pressure plate 17 is provided with a plurality of threaded bores 28 which are adapted to threadably receive therein a like number of depending pressure pins 29. The free ends of the pressure pins 29 are truncated as at 30 and are adapted to sit within a center cone-shaped recess 31 of an insert socket 32 provided by a pressure head 33.

As shown in FIG. 2, the pressure head 33 provides a head plate 34 to which is connected a depending Teflon ring 35. Within the ring 35 and connected to the head plate 34, is a porous workpiece carrier 36. It is noted that the workpiece carrier 36 has a depth slightly less than the depth of the ring 35 so as to provide a workpiece-receiving pocket 37.

As shown in FIG. 4, the insert socket 32 provides a circular body 38 having a threaded shank 39 adapted to be threaded into a threaded counterbore 40 formed in the workpiece carrier 36. The circular body 38 has formed therein the cone-shaped recess 31, exposed through a center opening 41 formed by the head plate 34. As shown in FIG. 4, the cone-shaped recess 31 terminates into a counterbore 42, the purpose of which will be hereinafter made apparent.

As shown in FIG. 3, the pressure pin 29 is formed to provide a centerbore 43 which is adapted to frictionally receive the elongated circular body 44 of a positioning rod 45.

In operation, the head 33 may be removed from the surface of the polishing plate 13 and have a workpiece positioned within the workpiece-receiving pocket 37. The workpiece may be removably affixed thereto by any suitable method well known in the art. The head 33 is then replaced on the polishing plate 13 generally beneath the pressure plate 17, which would normally be in its elevated position, such as shown on the right of FIG. 1. The operator would then forcibly depress the positioning rod 45 until it would pass through the pressure pin 29 and be projected into the counterbore 42 of the insert socket 32. This then would align the center of the head 33 with the depending pressure pin 29 of the pressure plate 17.

It is desired that each pressure plate 17 be provided with a number of head-positioning stations, each of which is defined by a depending pressure pin 29, all of which have the same construction as heretofore noted. Thus, when the three heads 33 are positioned beneath each of the pressure plates 17 and have been correctly located through the rod 25 with respect to the depending pressure pin 29, the vertical columns 14 may be hydraulically activated so as to lower the arms 15 and the respective pressure plates 17 carried thereby, until the truncated end 30 of each of the pressure pins 29 is seated within the cone-shaped recess 31 of the insert socket 32 in the manner shown in FIG. 2. Pressure may then be applied through the spindle 16, coupler 18, pressure plate 17, and pressure pins 29, onto the head 33, which in turn holds in place the workpiece carried thereby under pressure onto the polishing plate 13.

By the use of the universal swivel connection between the pressure plate 17 and the spindle 16, as well as the single point of engagement between the pressure pin 29 and the insert socket 32 of the head 33, any distortion or deflection between the parts of the fixture is minimized. The pressure plate 17 will have a floating action through its universal swivel connection with the spindle 16, permitting it to rotate through its normal horizontal plane, while the centralized exertion of pressure through the pressure pins 29 will permit the heads 33 to seek their own horizontal plane and to assume the profile of the workpiece to be polished without deflection thereof and to permit the heads 33 to rotate independently of the rotation of the pressure plate 17, during the polishing operation.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A fixture for a polishing machine having a rotatable polishing plate and at least one vertically movable vertical spindle supported above the polishing plate, the improvement comprising a. a circular horizontally disposed pressure plate carried by and movable vertically with the spindle, b. means connecting the spindle centrally of said pressure plate, c. a circular workpiece-carrying head having a diameter less than that of said pressure plate positionable upon the rotatable polishing plate beneath and partially beyond the periphery of said pressure plate, d. means depending from said pressure plate for engaging said head as said pressure plate is moved vertically in the direction of said polishing plate, and e. cooperating means carried centrally of said head to freely receive said engaging means so as to position said head on said polishing plate under pressure.

2. A fixture for a polishing machine as defined by claim 1 and including means carried by and movable through said engaging means and projectable into said cooperating means carried by said head for vertically aligning said engaging means and said cooperating means before said pressure plate is vertically moved in the direction of said polishing plate.

3. A fixture for a polishing machine as defined by claim 1, wherein said means depending from said pressure plate for engaging said head comprises a hollow elongated pin radially disposed from the center of said pressure plate.

4. A fixture for a polishing machine as defined by claim 3 and including means movable through said hollow pressure pin and projectable into said cooperating means carried by said head for vertically aligning said pressure pin and said cooperating means before said pressure plate is vertically moved in the direction of the polishing plate.

5. A fixture for a polishing machine as defined by claim 1, wherein said cooperating means carried by said head comprises a socket threadably carried centrally of said head with the socket formed to provide an inverted cone-shaped center opening adapted to receive the free end portion of said engaging means depending from said pressure plate.

6. A fixture for a polishing machine as defined by claim 3, wherein said cooperating means carried by said head comprises a socket threadably carried centrally of said head with the socket formed to provide an inverted cone-shaped center opening adapted to receive the like formed free end portion of said pressure pin depending from said pressure plate.

7. A fixture for a polishing machine as defined by claim 6, wherein there is included means movable through said hollow pin and projected into a center opening provided by said socket for vertically aligning said pin and said socket before said pressure plate is vertically moved in the direction of the polishing plate.

8. A fixture for a polishing machine as defined by claim 1 including a plurality of circular workpiece-carrying heads positionable upon the polishing plate beneath said pressure plate, and a plurality of engaging means depending from said pressure plate with said means being radially disposed from the center of said pressure plate and angularly arranged with respect to each other so as to be simultaneously independently engageable with said plurality of workpiece-carrying heads.

9. A fixture for a polishing machine as defined by claim 8, wherein said plurality of engaging means comprises elongated pressure pins depending from the under side of said pressure plate with said pins being radially disposed from the center of said pressure plate and angularly arranged with respect to each other so that each of said heads is simultaneously independently engageable with one of said plurality of workpiece-carrying heads.

* * * * *